US005176238A

United States Patent [19]

Deglau

[11] Patent Number: 5,176,238

[45] Date of Patent: Jan. 5, 1993

[54] COIN COLLECTION DEVICE

[76] Inventor: Robert K. Deglau, 720 King St., Regina, Saskatchewan, Canada S4T 4C9

[21] Appl. No.: 640,836

[22] Filed: Jan. 14, 1991

[51] Int. Cl.[5] ..... G07D 3/00

[52] U.S. Cl. ..... 194/338; 194/344; 194/352; 446/8

[58] Field of Search ..... 194/325, 352, 338, 342, 194/344; 453/5, 9; 446/8, 9, 10, 11

[56] References Cited

U.S. PATENT DOCUMENTS 1,923,535 8/1933 Gottfried ..... 194/325 X
2,076,862 4/1937 Patzer ..... 194/325
2,966,003 12/1960 Kreiss ..... 446/11
3,375,912 4/1968 Weitzman ..... 194/352 X
3,757,918 9/1973 Fongere ..... 194/325

*Primary Examiner*—F. J. Bartuska
*Attorney, Agent, or Firm*—Adrian D. Battison; Stanley G. Ade; Murray E. Thrift

[57] ABSTRACT

A coin collection device for charity comprises a generally upright body having a transparent front surface through which a track can be observed running from a coin feed slot at the top to a collection box at the bottom. The track divides into two branches at an intersection designed with a ramp so that coins approaching the intersection will normally jump a first branch and enter the other branch. An obstacle causes larger coins to divert into the first branch. Downstream of the intersection both branches are convoluted and intersect at least once for amusement value.

6 Claims, 2 Drawing Sheets

COIN COLLECTION DEVICE

FIELD OF THE INVENTION

This invention relates to a money collection device, more particularly to a coin collection device.

BACKGROUND OF THE INVENTION

Devices that collect money, particularly coins, for charity are well known. These devices generally provide an amusing aspect in the way that they collect the money.

More recently, charities have become more aggressive in pursuing the individuals' charitable donations, and devices have been developed that take the individuals' money as well as providing a means of amusement or entertainment. By locating these devices in selected locations, charities have discovered a new and lucrative method of soliciting donations.

SUMMARY OF THE INVENTION

It is one object of the present invention therefore to provide a coin collection device of an improved arrangement to provide a high level of user interest.

The present invention therefore provides a coin collection device comprising an enclosed unit having a top end and a bottom end, a front face and a back face, at least one coin pathway therein and a means for viewing of same through the front face of the device; said device having a slot opening positioned adjacent the top end of the said device, said slot opening to accept coins on their edge; said pathway extending downwardly from the said slot opening, said pathway constructed to accommodate the coin moving on its edge by gravitational pull, said pathway being arranged to allow visibility of said coin moving along the pathway; said pathway having at least one intersection in which the pathway branches into at least two openings and two branch pathways extending therefrom, said pathway having a slightly elevated ramp portion approaching the said intersection, said ramp constructed at an angle to allow the moving coin to jump the width of one branch opening and to enter the second branch opening and proceed along the pathway extending therefrom; all pathways extending to a means for collection of the said coins at the bottom of the said device.

The present invention invites the curiosity of the potential contributor as it provides two different pathways for the contributors' coins. Proper location of these devices in a restaurant or store by the operator will allow him/her to collect funds for his/her favorite charity.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures. DETAILED DESCRIPTION A coin collection device as shown generally at 10. The box-like device has a top 12, a bottom 14, a front side 16 and a back side 18.

Figure 1:
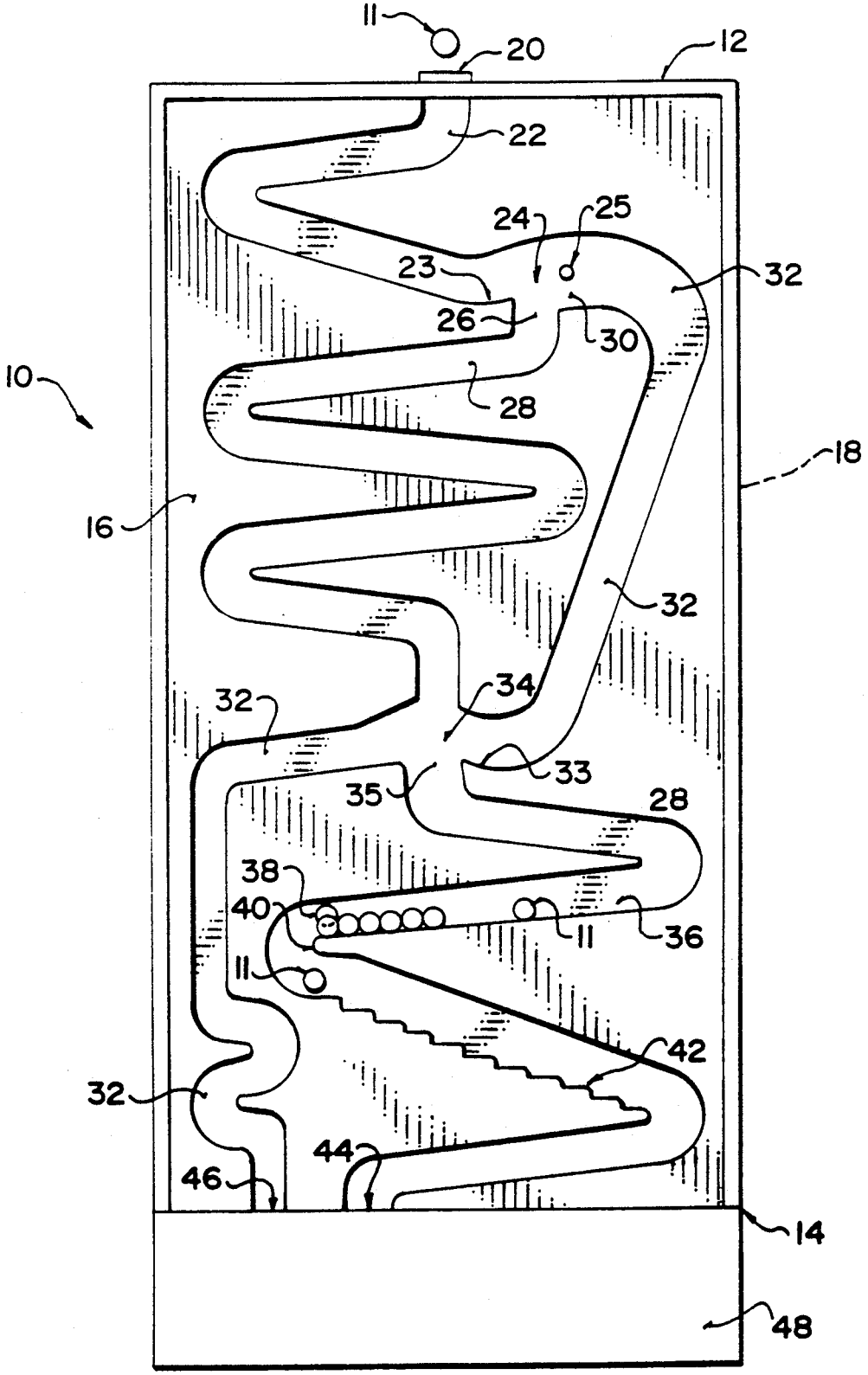
FIG. 1 is a side view of one embodiment of the present invention.

On the top of the device there is a slot 20. The slot is of sufficient size to allow the insertion of a coin 11 of any size, on its edge. There is extending from this slot a pathway 22 that accomodates the passage of the coin 11. The pathway 22 extends downwardly to a ramp portion 23 on pathway 22. At the end of this ramp portion 23 there is an intersection 24 having a rubber bumper 25 positioned thereon. Extending downwardly from the intersection 24 through a first opening 26 is a first pathway 28, and through a second opening 30 a second pathway 32.

The pathways 28 and 32 move down the device and intersect again at a lower intersection 34 on the device. The pathway 32 then extends from the intersection 34 downwardly to the bottom of the device, however pathway 28 winds and extends to an almost horizontal direction 36 within the device. Both branches of the pathway thus include a plurality of changes of direction as they wind from the intersection to the collection container at the bottom. At the end of this horizontal pathway portion 36 there is a recessed magnet 38 positioned within the pathway. Just beyond this magnet on the pathway 36, projecting downwardly is a vertical ledge 40 from the base of which there is extending downwardly therefrom a series of stairs 42. From the base of the steps the pathway continues to the bottom 14 of the device.

Both pathways empty through their respective openings shown at 44 and 46, into a collection receptacle 48.

In operation, a coin 11 is dropped, on its edge, through slot 20 into the pathway 22. The coin moves on its edge along the pathway 22 to the ramp portion 23. The coin 11 rolls off of the ramp 23 into the intersection 24 above opening 26. At this point, the larger coins such as quarters, half dollars and dollars collide with the rubber bumper 25 and fall down through opening 26 into pathway 28. Smaller coins such as pennies, nickels and dimes pass through the intersection 24, over the opening 26 and below the rubber bumper 25 into opening 30. The coins then proceed along pathway 32.

Pathways 28 and 32 extend downwardly and intersect once again at intersection 34, where the smaller coins once again leave ramp 33 and extend over the opening 35 to the continuing ramp 32 that extends downwardly to the bottom of the device and into the coin collection receptacle 48.

The larger coins however travel along pathway 28, through intersection 34 and through opening 35 to the essentially horizontal pathway section 36. The coin 11, having slowed down as it enters section 36, comes to a stop as it meets and engages the recessed magnet 38 at the end of the horizontal portion 36.

In order to dislodge the coin from the magnet attachment 38 a subsequent large coin must be dropped through slot 20, which travels through the large coin pathway as described above. As the coin enters the section 36 it collides with the magnetically attached coin at 38 and dislodges it, thereby pushing it over the ledge 40 and on to the series of stairs 42. The second coin however, having lost its momentum by colliding with the first coin, becomes magnetically attached to the recessed magnet 38. To move this coin along the pathway, a further large coin will have to be dropped through the slot 20. After the coin 11 descends a series of steps 42, it enters the final stage of the pathway and falls into the collection receptacle 48. The receptacle 48 will have an opening thereon (not shown) to enable a person to empty the receptacle and gather the contributions.

Figure 2:
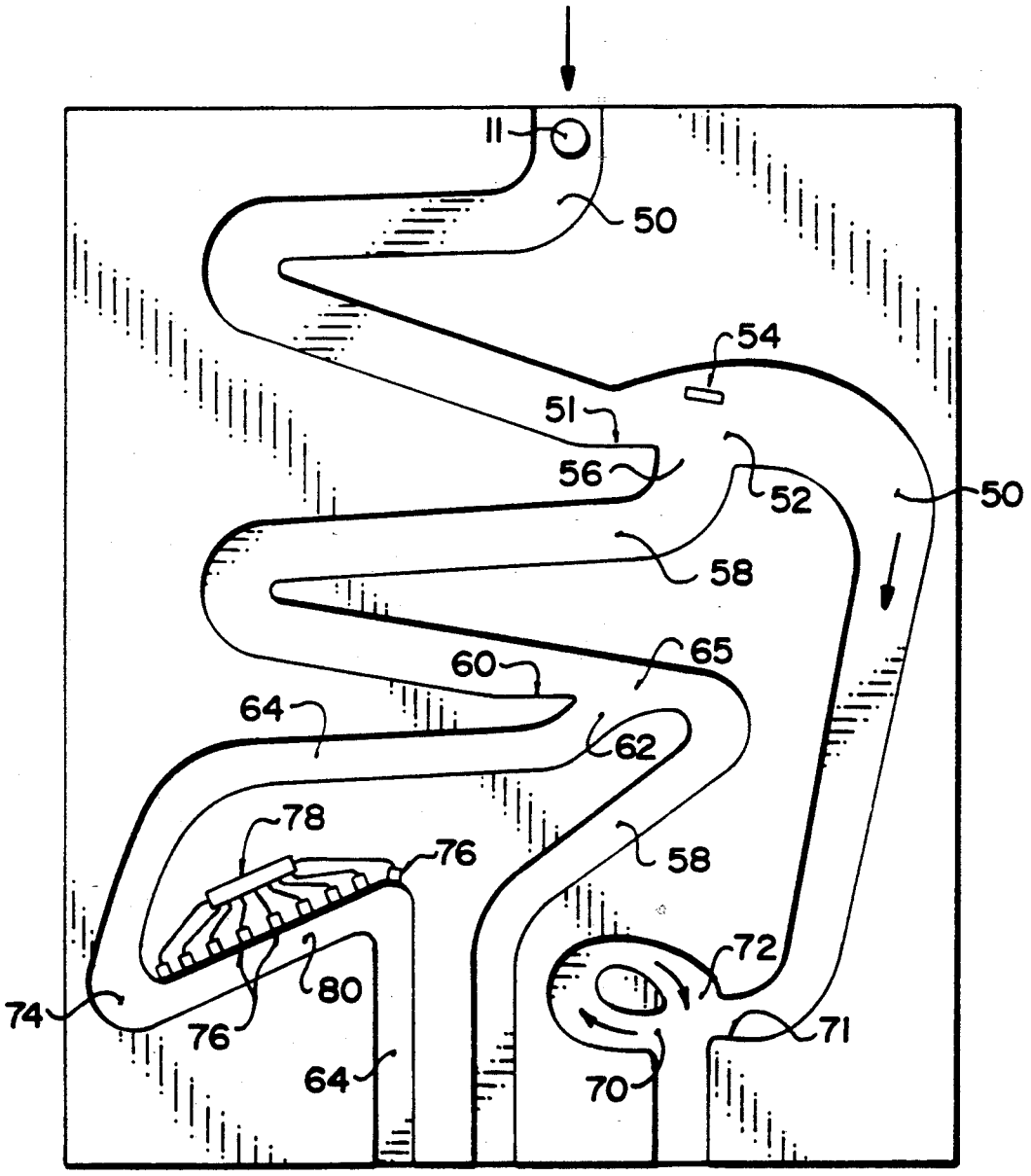
FIG. 2 is a side view of an alternate embodiment of the present invention.

An alternate pathway arrangement is shown in FIG. 2. This pathway may be in addition to the pathway set out in the first embodiment described, if desired.

The coin 11 enters pathway 50 which extends to a ramp 51 adjacent an intersection 52. At the intersection 52 there is a recessed magnet 54 that slows the quarter and dollar coins. Once the dollars and quarters are slowed, they fall through opening 56 and into a branch pathway 58. The coins proceed on their edge through pathway 58 to another ramp 60 adjacent an intersection 65. This "squeeze" ramp only allows quarters to successfully jump the opening 62 and proceed along pathway 58. The one-dollar coins are too large to pass and they fall back through opening 62, and into pathway 64. The one-dollar coins proceed downwardly along pathway 64 to a bend 74 that causes the coin to abruptly stop and move up slightly. When the coin moves upwardly it is engaged by the first of series of two-volt electromagnets 76 operating on a three-channel circuit. As a result of this sequencial operation of the magnets 76, from the control bar 78, the coin moves upwardly along a portion 80 of the pathway 64. At the top of this portion 80, the coin then drops off the edge, through pathway 64 and into the collection receptacle 48.

The quarters, once they leap opening 62 proceed through opening 65 and continue along pathway 58 to the collection receptacle 48.

The pennies, nickels and dimes leap the opening 56 and bypass the recessed magnet 54 to proceed down pathway 50.

The pennies, nickels and dimes fall down a substantially vertical part of pathway 50 to a ramp 71. From this ramp they enter a loop portion of the pathway 50. The coins enter the loop through opening 70 and exit the loop through opening 72. Coins then proceed into the collection receptacle 48.

The device shown in FIG. 1 invites the curiosity of potential operators by providing two different pathways for coins to travel. Should a person wish to see the operation of both pathways, his contribution would be a minimum of 26 cents. Further, should there be no coin positioned at the magnet 38, the operator may have to put in an additional coin to observe the final steps of the collection procedure. As it takes a large coin to dislodge a large coin from the magnet 38, the result is more money being donated to charity.

Since various modifications can be made in my invention as hereinabove described, and many apparently widely different embodiments of same made within the spirit and scope, it is intended that all matter contained in the accompanying specification shall be interpreted as illustrative only and not in a limiting sense.

I claim:

1. A coin collection device comprising an enclosed unit having a top end and a bottom end, a front face and a back face, means defining a coin pathway therein the front face being transparent so as to allow viewing of the pathway along its length; said device having a slot shaped opening positioned adjacent the top end of the said device shaped to accept a coin on its edge, a coin collection container arranged adjacent the bottom end, said coin pathway extending downwardly from the said opening and arranged to cause movement of the coin along the pathway on its edge by gravitational pull from the opening to the container, said pathway having an intersection at which the pathway divides into two branches extending from the intersection, said pathway including said branches being defined by said front face and by two generally parallel side walls extending along the pathway and forming therebetween a discrete continuous path for the coins spaced by a distance sufficient to receive the coin rolling on one of said two side walls, said pathway immediately before the intersection having an elevated ramp portion approaching said intersection, said ramp constructed at an angle to allow the coin to jump across the width of one of the branches and to enter the other branches, and obstacle means at the intersection arranged to engage coins of diameter greater than a predetermined diameter to cause those coins of greater diameter to enter said one branch while coins of smaller diameter to enter said other branch, each of the branches downstream of the intersection including portions thereof having a plurality of changes of direction and a second intersection at which the branches intersect, the branches being shaped at the intersection such that a coin moving along a respective one of the branches continues along the respective one of the branches to the container.

2. A coin collection device as claimed in claim 1 including means on said pathway for halting the movement of the coin at a specific location on said pathway, said specific location being provided immediately prior to a ledge over which the coin can fall, and provided on a ramp such that a row of halted coins can be formed with the weight of the row being sufficient to cause one coin to fall over the ledge.

3. A coin collection device as claimed in claim 2 in which the means for halting is a magnet.

4. A coin collection device as claimed in claim 1 in which said pathway has a portion thereof defining a plurality of sequantial descending steps.

5. A coin collection device as claimed in claim 1 in which the pathway has a looped portion thereon.

6. A coin collection device as claimed in claim 1 in which said pathway includes a portion thereof inclined upwardly together with a series of electromagnets adjacent said upwardly inclined portion and arranged to move the coin upwardly along said inclined portion.

* * * * *